US009164488B2

(12) United States Patent
Bolzt et al.

(10) Patent No.: US 9,164,488 B2
(45) Date of Patent: Oct. 20, 2015

(54) CASE FOR A TIMEPIECE

(71) Applicant: MONTRES RADO SA, Lengnau (CH)

(72) Inventors: Sebastien Bolzt, Bienne (CH); Yannick Hunziker, Vicques (CH)

(73) Assignee: MONTRES RADO SA, Lengnau (CH)

( * ) Notice: Subject to any disclaimer, the term of this patent is extended or adjusted under 35 U.S.C. 154(b) by 0 days.

(21) Appl. No.: 14/358,561

(22) PCT Filed: Nov. 14, 2012

(86) PCT No.: PCT/EP2012/072604

§ 371 (c)(1),
(2) Date: May 15, 2014

(87) PCT Pub. No.: WO2013/072360

PCT Pub. Date: May 23, 2013

(65) Prior Publication Data

US 2014/0313870 A1 Oct. 23, 2014

(30) Foreign Application Priority Data

Nov. 17, 2011 (EP) ..... 11189481

(51) Int. Cl.

| | |
|---|---|
| ***G04B 19/06*** | (2006.01) |
| ***G04B 39/00*** | (2006.01) |
| ***G04B 37/00*** | (2006.01) |
| ***G04B 39/02*** | (2006.01) |

(52) U.S. Cl.

CPC ..... *G04B 37/005* (2013.01); *G04B 37/0008* (2013.01); *G04B 37/0016* (2013.01); *G04B 37/0025* (2013.01); *G04B 37/0033* (2013.01); *G04B 37/0041* (2013.01); *G04B 39/00* (2013.01); *G04B 39/02* (2013.01)

(58) Field of Classification Search

CPC ..... G04B 37/0008; G04B 37/0016; G04B 37/0025; G04B 37/0041; G04B 37/005

USPC ..... 368/232, 236, 294–298, 309–313

See application file for complete search history.

(56) References Cited

U.S. PATENT DOCUMENTS

| | | | | |
|---|---|---|---|---|
| 1,903,003 | A * | 3/1933 | Mansfield | 368/236 |
| 2,845,773 | A * | 8/1958 | Sakalys | 368/286 |
| 3,264,820 | A * | 8/1966 | Piquerez | 368/292 |
| 3,782,105 | A * | 1/1974 | Nozawa | 368/292 |
| 4,223,527 | A * | 9/1980 | Tutiya et al. | 368/283 |
| 4,397,567 | A * | 8/1983 | Carl | 368/309 |

(Continued)

FOREIGN PATENT DOCUMENTS

| | | |
|---|---|---|
| CH | 629 644 A | 5/1982 |
| CH | 636 743 A | 6/1983 |

(Continued)

*Primary Examiner* — Amy Cohen Johnson
*Assistant Examiner* — Daniel Wicklund
(74) *Attorney, Agent, or Firm* — Sughrue Mion, PLLC

(57) ABSTRACT

Case for a timepiece, including a middle part with an upper portion for receiving a movement surmounted by a dial carrying an upper sub-assembly or a crystal, and a lower portion cooperating with a back cover. This middle part includes a device for the removal or adjustment of this upper sub-assembly or crystal, which includes a plurality of pushers each movable in relation to this middle part in a sink of this middle part parallel to an axial direction, to transmit, directly or indirectly via a push plate, only to this dial, a force applied to each pusher in this direction from this lower portion and transmitted by this dial to this upper sub-assembly or crystal.

17 Claims, 2 Drawing Sheets

(56) References Cited

U.S. PATENT DOCUMENTS

| | | | | |
|---|---|---|---|---|
| 4,505,596 | A * | 3/1985 | Barbieri et al. | 368/236 |
| 4,796,240 | A * | 1/1989 | Stevens | 368/281 |
| 5,237,546 | A * | 8/1993 | Vollert | 368/294 |
| 5,699,324 | A * | 12/1997 | Perrot et al. | 368/226 |
| 6,406,178 | B1 * | 6/2002 | Luscher et al. | 368/286 |
| 6,762,976 | B1 * | 7/2004 | Tamaru et al. | 368/88 |
| 8,520,474 | B2 * | 8/2013 | Cadau et al. | 368/236 |
| 2006/0114753 | A1 * | 6/2006 | Gerber | 368/295 |
| 2009/0040882 | A1 * | 2/2009 | Hiranuma et al. | 368/295 |

FOREIGN PATENT DOCUMENTS

| | | | |
|---|---|---|---|
| CH | 646 028 | A | 11/1984 |
| EP | 0 111 449 | A2 | 6/1984 |
| EP | 1 712 959 | A1 | 10/2006 |
| GB | 2002151 | A * | 2/1979 |

* cited by examiner

CASE FOR A TIMEPIECE

CROSS REFERENCE TO RELATED APPLICATIONS

This application is a National Stage of International Application No. PCT/EP2012/072604 filed Nov. 14, 2012, claiming priority based on European Patent Application No. 11189481.2 filed Nov. 17, 2011, the contents of all of which are incorporated herein by reference in their entirety.

FIELD OF THE INVENTION

The invention concerns a case for a timepiece, said case including a middle part for receiving at least one movement surmounted by a dial, said dial directly or indirectly carrying an upper sub-assembly or a crystal in proximity to an upper portion of said middle part or to a bezel fixed to said middle part, and said case further including a back cover cooperating with said middle part in proximity to a lower portion of said middle part, opposite to said upper portion.

The invention also concerns a timepiece including, housed inside a case of this type, at least one movement surmounted by a dial, said dial directly or indirectly carrying an upper sub-assembly or a crystal in the upper portion.

The invention concerns the field of horology, and more specifically the field of the protection of timepiece mechanisms.

BACKGROUND OF THE INVENTION

In horology, the disassembly of a watch may be as difficult as the assembly thereof.

In particular, numerous sub-assemblies, such as movement-display assemblies, are fitted in the case from above, i.e. from the crystal side. This type of assembly generally includes, in addition to the movement, a dial and display members formed by hands or discs. The dial is in principle surmounted by a flange. The crystal is then driven into the middle part. It is usual to use a compressed air extractor to drive off the crystal, in order to access this assembly again.

CH Patent Application No 646028G in the name of MONTRES RADO SA provided a first response to this problem, by implementing a watch case which includes a middle part-bezel including an aperture that can be closed by a crystal, an upper housing and a lower aperture of smaller dimensions to those of the upper housing. This case further includes a crystal and a back cover removably secured to the middle part-bezel on either side thereof. The back cover is preferably fixed by screws to the middle part-bezel, and the crystal is held by slide bars. A casing ring, which is radially supported on the middle part-bezel via two stepped surfaces having different radii, at the level of the upper housing and the lower aperture, retains the watch movement radially and axially. In the assembled position, the casing ring is axially supported, via a lower gasket on the back cover on the one hand, and via an upper gasket and/or a flange on the crystal on the other hand. The casing ring, carrying the movement on a shoulder, can thus be introduced into the middle part-bezel on the upper housing side, and inserted into the lower aperture. The dial covers both the movement and the casing ring. The crystal is then set in place after inserting the upper sealing gasket and positioning the annular flange. On the opposite side, the back cover is screwed on, in a first variant onto the middle part-bezel compressing the lower sealing gasket against the casing ring, or in a second variant onto the casing ring compressing the lower sealing gasket and pressing a shoulder of the casing ring onto a shoulder of the middle part-bezel. Tightening the screws in both cases locks the casing ring inside the case. To disassemble the watch, the back cover and stem have to be removed, and the crystal taken off by pressing the lower portion of the casing ring, the pressure being transmitted to the crystal via the flange. This design allows cases of small thickness to be constructed, and the dimensions of the back cover to be reduced. However, the crystal must be disassembled either by a compressed air extractor, or by moving the casing ring and thus the movement.

In a similar manner, CH Patent Application No 629644G in the name of SAUCO Saunier & Cie discloses a casing ring which, from the back cover, extends over the entire height of the case, and directly supports the crystal. The removal of the crystal, together with the removal of the movement, is accomplished by pushing the lower portion of the casing ring.

Although these designs ensure correct sealing of the case, and the secure disassembly of the crystal and of the movement, they have the drawback of moving the casing ring and thus the movement, during the crystal removal operation.

SUMMARY OF THE INVENTION

The invention proposes to overcome the problem of disassembling the crystal without using compressed air and without moving the movement when the crystal is removed.

The invention therefore concerns a case for a timepiece, said case including a middle part for receiving at least one movement surmounted by a dial, said dial directly or indirectly carrying an upper sub-assembly or a crystal in proximity to an upper portion of said middle part or a bezel fixed to said middle part, and said case further including a back cover cooperating with said middle part in proximity to a lower portion of said middle part, opposite said upper portion, characterized in that said middle part includes a device for removing or adjusting said upper sub-assembly or said crystal, said removal device including a plurality of pushers each movable in relation to said middle part in a sink comprised in said middle part, parallel to an axial direction of assembly/disassembly of the components of said timepiece, to transmit, directly or indirectly via a push plate, only to said dial a force applied to each said pusher in said axial direction from said lower portion, said force being transmitted by said dial to said upper sub-assembly or to said crystal.

According to a feature of the invention, said pushers exert a uniform push force on said dial via a single said push plate.

According to a feature of the invention, said dial carries a flange which in turn carries said upper sub-assembly or said crystal.

According to a feature of the invention, said sinks each include a lower aperture on the side of said lower portion, and said back cover conceals, in the assembled state of said case, said lower apertures.

According to a feature of the invention, each said sink passes right through said middle part in said axial direction, from a lower aperture on the side of said lower portion to an aperture located in proximity to said upper portion and allowing the passage of said pusher.

According to a feature of the invention, at least one said pusher is free to rotate in said respective sink about a direction parallel to said axial direction.

According to an alternative feature of the invention, at least one said pusher cooperates via an external thread with an internal thread comprised in said respective sink about a parallel direction to said axial direction.

According to a feature of the invention, said sinks are identical and equipped with identical pushers, and said removal device is arranged to cooperate with a push tool intended to be introduced into said lower portion of said middle part after the removal of said back cover, said push tool including as many spindles as there are said pushers to apply an equal force onto each pusher with an identical travel in said axial direction.

The invention also concerns a timepiece including, housed inside a case of this type, at least one movement surmounted by a dial, said dial directly or indirectly carrying an upper sub-assembly or a crystal in the upper portion, characterized in that said dial cooperates with said removal or adjustment device to remove said upper sub-assembly or said crystal.

According to a feature of the invention, said dial is only placed on an upper portion of said movement which remains immobile in relation to said middle part during the removal of said top sub-assembly or of said crystal during a lower push action on said pushers of said removal or adjustment device.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
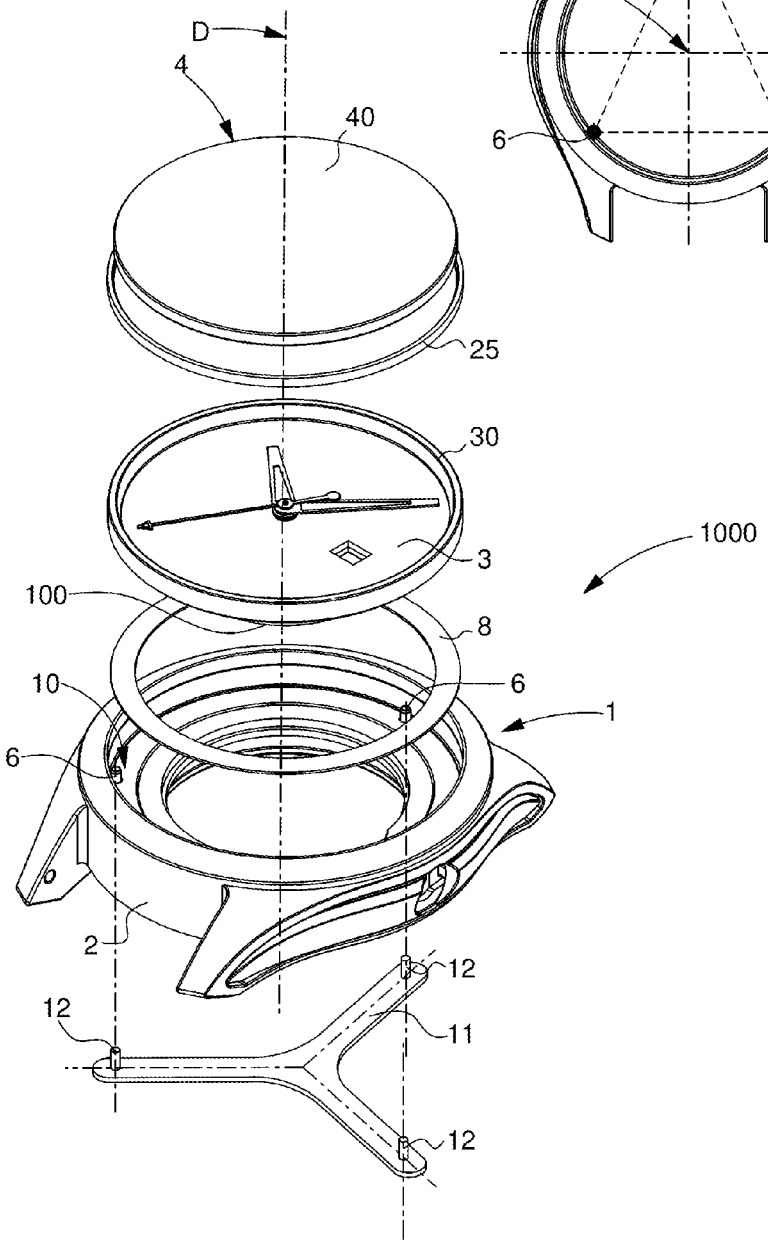
FIG. 1 shows a schematic, partial, exploded, perspective view of a timepiece including a case according to the invention without its back cover, and a push tool for the removal or adjustment of a the crystal of said timepiece.

The invention concerns the field of horology, and more specifically the field of the protection of timepiece mechanisms.

The invention concerns a case 1 for a timepiece 1000.

This case 1 includes, in a conventional manner, a middle part 2 for receiving at least one movement 100 surmounted by a dial 3. Dial 3 directly or indirectly carries an upper sub-assembly 4, for example formed of complementary display modules, or suchlike, or carries a crystal 40, in proximity to an upper portion 21 of middle part 2 or a bezel 9 fixed to said middle part 2. This sub-assembly 4, or crystal 40, depending on the case, is usually driven into bezel 9 or middle part 2, or into an upper sealing gasket 25 carried by said bezel 9 or said middle part 2. This upper sealing gasket 25 then radially encircles upper sub-assembly 4 or crystal 40.

Case 1 further includes a back cover 5 cooperating with middle part 2 in proximity to a lower portion 22 of middle part 2, which is opposite upper portion 21.

According to the invention, middle part 2 includes a device 10 for removing or adjusting upper sub-assembly 4 or crystal 40. This device is operational when back cover 5 is removed.

The Figures illustrate a preferred and non-limiting application wherein case 1 is devised to enable crystal 40 to be easily removed.

Removal or adjustment device 10 includes a plurality of pushers 6. Each pusher 6 is movable in relation to middle part 2 in a sink 7 comprised in said middle part 2, parallel to an axial assembly/disassembly direction D of the components of timepiece 1000 in case 1.

Preferably, as seen in the Figures, sinks 7 each include a lower aperture 72 on the side of lower portion 22 of middle part 2. Back cover 5 preferably conceals these lower apertures 72 in the assembled state of case 1.

Each sink 7 passes right through middle part 2 in a direction parallel to axial direction D, from a lower aperture 72 on the side of lower portion 22 of middle part 2, to an upper aperture 71 situated in proximity to upper portion 21 of the middle part and allows the passage of pusher 6.

Preferably, the contact between each pusher 6 and the respective sink 7 is ensured in a sealed manner by a sealing gasket 60.

Each pusher 6 is pushed under the action of a force applied thereto, in said axial direction D, from lower portion 22 of middle part 2, the push force being applied by an operator, and preferably using a push tool 11.

In a very simple embodiment, as seen in FIG. 1, this push tool 11 is intended to be inserted into lower portion 22 of middle part 2 after the removal of back cover 5, and includes as many spindles 12 as pushers 6, to apply an equivalent force on each with an identical travel in axial direction D. A simple relative movement of translation between a tool 11 of this type and middle part 2 is thus sufficient to drive off crystal 40.

Under the effect of this push force, each pusher 6 is moved in a motion which includes at least one translation component in this axial direction. As it moves, each pusher 6 is arranged to directly or indirectly transmit the push force only to dial 3. Pusher 6 moves in relation to middle part 2, which remains immobile during this motion of pusher 6. The push force is transmitted by dial 3 to upper sub-assembly 4 or to crystal 40, which enables said sub-assembly or said crystal to be driven off.

When, in a preferred manner, so as not to deform dial 3, it is chosen to transmit the push force from pusher 6 indirectly, this is accomplished using a push plate 8, which distributes the push force over a surface area of dial 3 which is sufficient large to prevent any deformation of the dial.

Preferably, the arrangement of the removal device is such that pushers 6 exert a uniform push force on dial 3 by means of a single said push plate 8. In a specific embodiment illustrated in the Figures, this push plate 8 is a ring which retains dial 3, from below, i.e. from the side facing lower portion 22 of middle part 2, at the periphery thereof.

In a particular variant illustrated in the Figures, dial 3 carries a flange 30 which in turn carries upper sub-assembly 4 or crystal 40. In that case, the push force is transmitted by pusher 6, push plate 8, where present, dial 3, flange 30 to upper sub-assembly 4 or to crystal 40. This flange 30 may be integral with dial 3, or be simply carried thereby. Preferably, flange 30 is centred on a bore comprised in middle part 2 or bezel 9.

Figure 3:
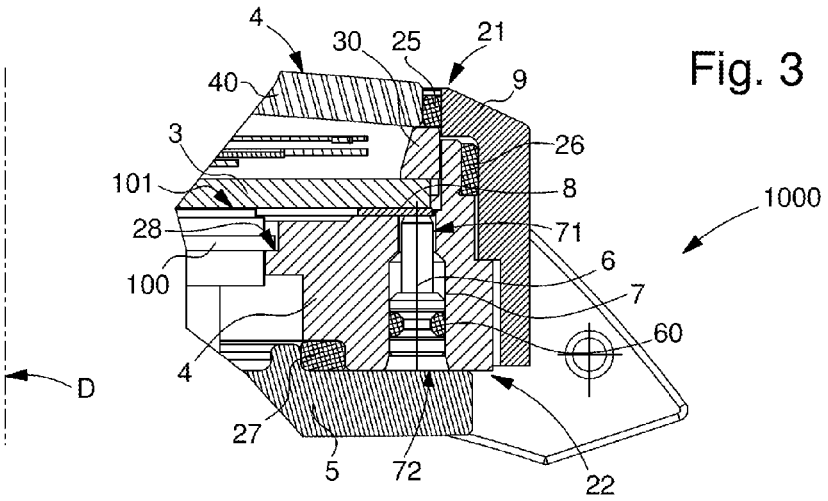
FIG. 3 shows a schematic, partial cross-section, in a parallel plane to a direction of insertion, of a timepiece according to the invention in a first variant wherein the middle part carries a peripheral bezel, and wherein the middle part includes a removal or adjustment device according to the invention with a rotating pusher sliding inside a rotating sink.
Figure 4:
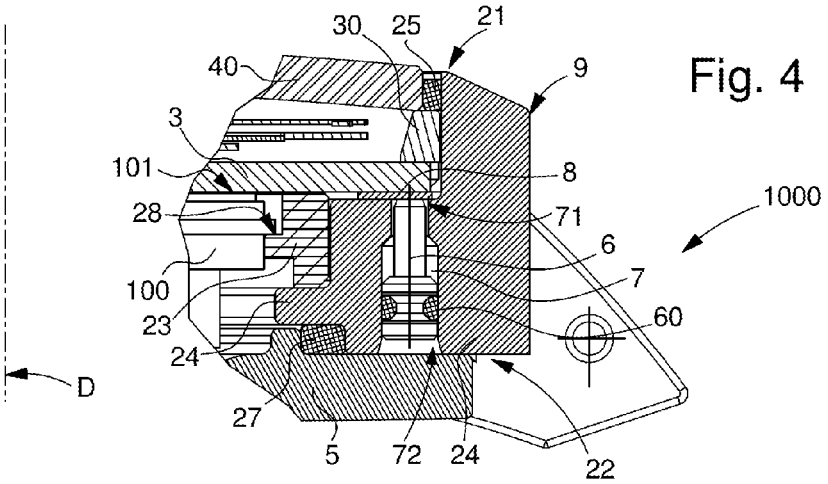
FIG. 4 shows, in a similar manner to FIG. 3, a second variant wherein the middle part is in two internal and external portions, the external portion including the sink and also forming the bezel, with a similar removal and adjustment device to that of FIG. 3.
Figure 5:
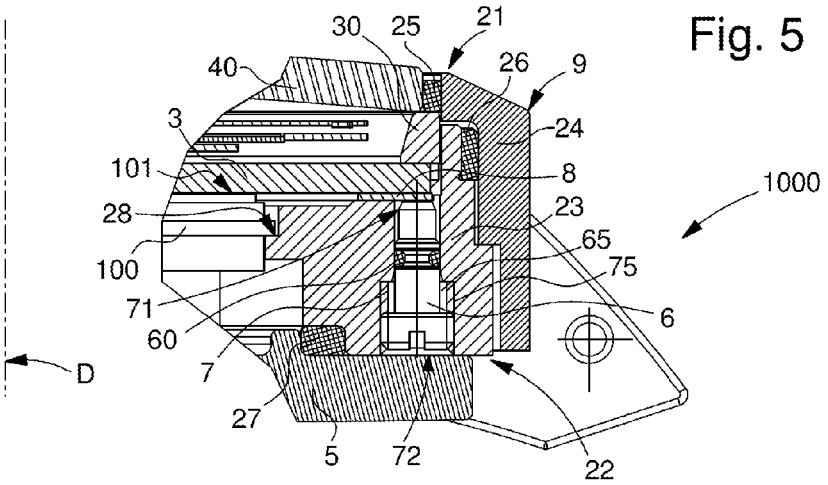
FIG. 5 shows, in a similar manner to FIG. 3, a third variant wherein the removal or adjustment device includes an externally threaded pusher cooperating with an internally threaded sink.

FIGS. 3 to 5 illustrate several variants of the middle part, and of removal device 10.

FIG. 3 shows a first variant wherein middle part 2 carries a peripheral bezel 9. Middle part 2 directly carries movement 100 on a shoulder 28 thereof. Middle part 2 carries sinks 7 of removal device 10. In this variant, at least one pusher 6 is free to rotate inside its respective sink 7 about a direction parallel to axial direction D, and preferably this is the case for all of pushers 6 and all of sinks 7 of middle part 2. FIG. 3 thus shows one of pushers 6, which rotates, and which slides in a rotating sink 7. This arrangement is chosen because it is inexpensive to produce. However, it is also possible to prohibit any rotational motion of pusher 6 in its sink 7, and to only allow a movement of translation, for example of a flat portion of pusher 6 between two flat portions of sink 7, or against a flat portion of sink 7, or otherwise. In this variant, it is bezel 9 which carries upper sealing gasket 25 for retaining flange 40, which is supported on flange 30.

FIG. 4 illustrates a second variant wherein the middle part is in two portions: inner portion 23 and outer portion 24, inner portion 23 carries movement 100 on a shoulder 28, and outer portion 24 includes sinks 7 and also forms bezel 9, with a similar removal device to that of FIG. 3. When middle part 2 is thus formed of several portions 23, 24, these portions are preferably coaxial and one inside the other, and preferably assembled enclosing a sealing gasket 26.

FIG. 5 illustrates a third variant, similar to FIG. 3 as regards middle part 2, and wherein removal or adjustment device 10 includes at least one threaded pusher 6, with an external thread 65, which cooperates with a respective threaded sink 7, on an internal thread 75, about a direction parallel to axial direction D. In a specific embodiment, this is the case of all of pushers 6 and all of sinks 7 of middle part 2. This variant is more expensive. It requires a very specific pushtool 11 to achieve a simultaneous pushing motion on all of pushers 6, with synchronised screwdriver bits. This type of multi-headed tool is well known as a tapping attachment in machining centres or other machine tools, and is perfectly possible to achieve on the scale of a watch case. The advantage of this variant, although it is more expensive than other versions, is that it ensures the perfectly controlled micrometric removal of crystal 40 or of upper sub-assembly 4. This configuration is particularly advantageous when sub-assembly 4 requires a precise altitude adjustment in relation to movement 100, or to dial 3. Case 1 of the invention, with a middle part 2 equipped with device 10 thus allows for a micrometric adjustment of this altitude. The choice of a particular pitch, notably a very fine pitch, prevents any loss of adjustment during use.

Preferably, middle part 2 cooperates with back cover 5 compressing a lower sealing gasket 2, in order to seal case 1.

Figure 2:
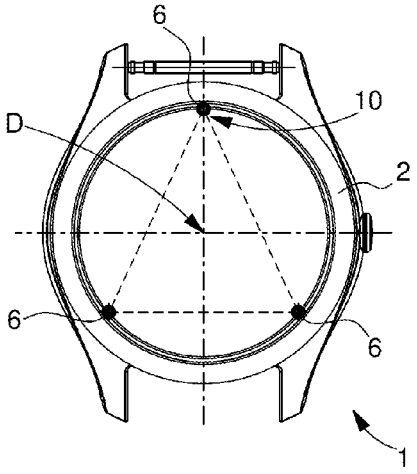
FIG. 2 shows a schematic front view of the case of the timepiece of FIG. 1.

FIGS. 1 and 2 illustrate an embodiment operating in a very satisfactory manner, with a removal device 10 which includes three identical sinks 7 equipped with identical pushers 6, said sinks 7 being arranged in an isosceles triangle whose axis of symmetry is situated in a plane of symmetry of middle part 2.

The invention further concerns a timepiece 1000 including, housed inside a case 1 of this type, at least one movement 100 surmounted by a dial 3. Dial 3 directly or indirectly carries an upper sub-assembly 4 or a crystal 40 of this type in the upper portion. According to the invention, dial 3 cooperates with a removal or adjustment device 10 to remove or adjust upper sub-assembly 4 or crystal 40.

In a preferred embodiment, dial 3 is simply placed on an upper portion 101 of movement 100, which remains immobile in relation to middle part 2 during the removal of upper sub-assembly 4 or crystal 40 when there is a lower pushing action on pushers 6 of removal or adjustment device 10.

In a preferred embodiment, all or part of case 1, in particular middle part 2 or bezel 9, or even back cover 5, is made of one-piece ceramic. The design of case 1 according to the invention avoids damaging the components, in particular as regards sharp edges or borders.

In the first variant of FIG. 3, middle part 2, back cover 5 and bezel 9 can thus be made of one-piece ceramic.

In the second embodiment of FIG. 4, the inner portion 23 and outer portion 24 of middle part 2, and back cover 5 can thus be made of one-piece ceramic. In a more economical approach, only outer portion 24 of middle part 2 and back cover 5, which are visible, are made of one-piece ceramic.

In the third variant of FIG. 5, middle part 2, back cover 5 and bezel 9 can be made of one-piece ceramic. However, middle part 2 then requires the insertion of a threaded insert, particularly bonded inside a housing, because of the difficulties involved in forming a thread in ceramic material. In this variant, it is more economical to limit the use of one-piece ceramic to making back cover 5 and bezel 9.

The invention claimed is:

1. A case for a timepiece, said case including a middle part for receiving at least one movement surmounted by a dial, said dial directly or indirectly carrying an upper sub-assembly or a crystal in proximity to an upper portion of said middle part or a bezel fixed to said middle part, and said case further including a back cover cooperating with said middle part in proximity to a lower portion of said middle part opposite to said upper portion, wherein said middle part includes a device for the removal or adjustment of said upper sub-assembly or of said crystal, said removal device including a plurality of pushers each movable in relation to said middle part in a sink comprised in said middle part, parallel to an axial direction of assembly/disassembly of the components of said timepiece, to transmit directly to said dial a force which is applied to each said pusher in said axial direction from said lower portion, said force being directly transmitted by said dial to said upper sub-assembly or to said crystal, wherein the force being transmitted by the plurality of pushers is configured to push said upper said-assembly or said crystal away from said middle part.

2. The case according to claim 1, wherein said dial carries a flange in turn carrying said upper sub-assembly or said crystal.

3. The case according to claim 1, wherein said middle part, or a bezel fixed to said middle part, carries an upper sealing gasket radially encircling said upper sub-assembly or said crystal.

4. The case according to claim 1, wherein said middle part is formed of more than one coaxial portions one inside the other, assembled enclosing a sealing gasket.

5. The case according to claim 1, wherein said middle part cooperates with said back cover in compressing a lower sealing gasket.

6. The case according to claim 1, wherein said sinks each include a lower aperture on the side of said lower portion and in that said back cover conceals, in the assembled state of said case said lower apertures.

7. The case according to claim 1, wherein each said sink passes right through said middle part in a direction parallel to said axial direction, from a lower aperture on the side of said lower portion to an upper aperture situated in proximity to said upper portion and allowing the passage of said pusher.

8. The case according to claim 1, wherein the contact between each said pusher and said respective sink is ensured in a sealed manner by a sealing gasket.

9. The case according to claim 1, wherein at least one said pusher is free to rotate inside said respective sink about a direction parallel to said axial direction.

10. The case according to claim 1, wherein at least one said pusher cooperates via an external thread with an internal thread comprised in said respective sink about a direction parallel to said axial direction.

11. The case according to claim 1, wherein said removal device includes three identical sinks equipped with identical pushers, said sinks being arranged in an isosceles triangle whose axis of symmetry is situated on a plane of symmetry of said middle part.

12. The case according to claim 1, wherein said sinks are identical and equipped with identical pushers, and in that said removal device is arranged to cooperate with a removable push tool and intended to be inserted into said lower portion of said middle part after the removal of said back cover, said push tool including as many spindles as said pushers to apply an equal force to each with an identical travel in said axial direction.

13. The case according to claim 1, wherein said middle part and/or said bezel, and/or said back cover is made of one-piece ceramic.

14. A timepiece including, housed inside a case according to claim 1, at least one movement surmounted by a dial, said dial directly or indirectly carrying an upper sub-assembly or a crystal in an upper portion, wherein said dial cooperates with said removal device to remove said upper sub-assembly or said crystal.

15. The timepiece according to the claim 14, wherein said dial is simply placed on an upper portion of said movement which remains immobile in relation to said middle part during the removal of said upper sub-assembly or of said crystal when there is a lower pushing action on said pushers of said removal device.

16. A case for a timepiece, said case including a middle part for receiving at least one movement surmounted by a dial, said dial directly or indirectly carrying an upper sub-assembly or a crystal in proximity to an upper portion of said middle part or a bezel fixed to said middle part, and said case further including a back cover cooperating with said middle part in proximity to a lower portion of said middle part opposite to said upper portion, wherein said middle part includes a device for the removal or adjustment of said upper sub-assembly or of said crystal, said removal device including a plurality of pushers each movable in relation to said middle part in a sink comprised in said middle part, parallel to an axial direction of assembly/disassembly of the components of said timepiece, to transmit indirectly via a push plate comprised in said case to said dial a force which is applied to each said pusher in said axial direction from said lower portion, said force being indirectly transmitted by said push plate to said upper sub-assembly or to said crystal, wherein the force being transmitted by the plurality of pushers is configured to push said upper said-assembly or said crystal away from said middle part.

17. The case for a timepiece according to claim 16, wherein said pushers exert a uniform push force on said dial via said push plate comprised in said case.

* * * * *